United States Patent [19]

Sundberg

[11] Patent Number: 5,037,370

[45] Date of Patent: Aug. 6, 1991

[54] METHOD FOR FOLDING FILM MATERIAL TO FORM A POLYGON PACKAGE OF SUCCESSIVE FOLDS

[75] Inventor: Sture Sundberg, Malmö , Sweden

[73] Assignee: Paxxo AB, Malmo, Sweden

[21] Appl. No.: 510,948

[22] Filed: Apr. 19, 1990

Related U.S. Application Data

[62] Division of Ser. No. 278,828, Dec. 2, 1988, Pat. No. 4,936,819.

[30] Foreign Application Priority Data

Dec. 9, 1987 [SE] Sweden ..... 8704907

[51] Int. Cl.[5] ..... B65H 45/12

[52] U.S. Cl. ..... 493/451; 493/458; 493/459; 493/940; 493/457

[58] Field of Search ..... 493/451, 457, 458, 459, 493/463, 940

[56] References Cited

U.S. PATENT DOCUMENTS 2,855,830 2/1956 Rowland .
4,106,398 8/1978 Buisson .
4,265,439 5/1981 Sundberg ..... 493/451
4,721,503 1/1988 Rasmussen et al. ..... 493/451

*Primary Examiner*—Frederick R. Schmidt
*Assistant Examiner*—John Addison Marlott
*Attorney, Agent, or Firm*—Ladas & Parry

[57] ABSTRACT

A method for the manufacture of a hose package by folding a hose of flexible material, where the hose package consists of folds adjoining one another and forming wall elements connected to one another. The elements are situated outside one another in relation to a central axis of the hose package. The device for carrying out the method has a fixing element and upper and lower folding plates in the shape of polygons. Through a controlled sequence of movements, the fixing element and folding plates form the folds situated outside one another, and thereby the hose package. The folding plates are placed adjacent to one another and in end regions form corners of the polygon. In the respective corner regions the plates are spaced from one another to form an opening or gap through which a pressing member can travel to contact the folds of the hose package and smooth out any wrinkles.

10 Claims, 6 Drawing Sheets

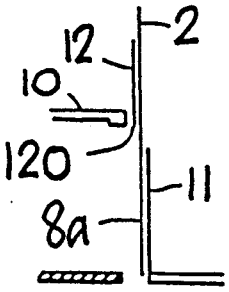
FIG. 2
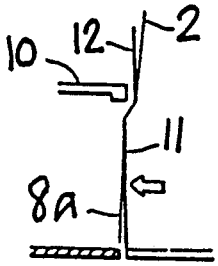
FIG. 3
FIG. 4
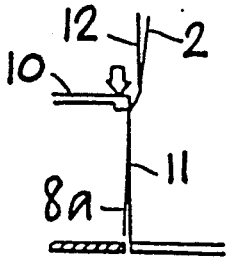
FIG. 5
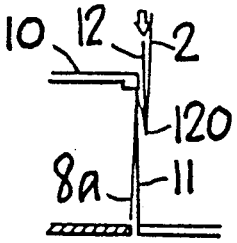
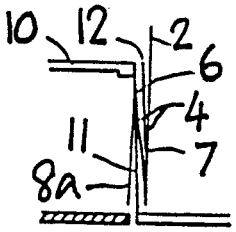
FIG. 6
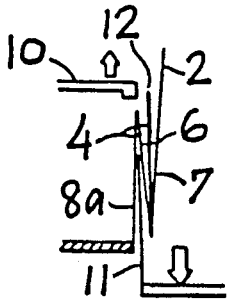
FIG. 7
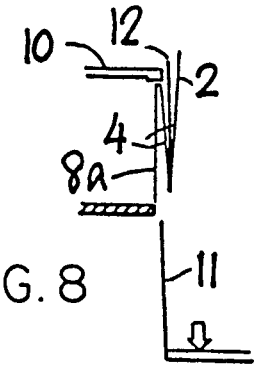
FIG. 8
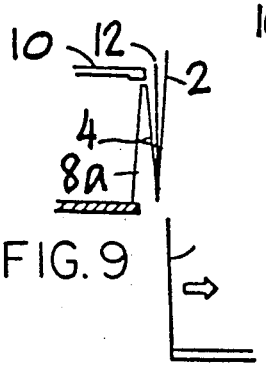
FIG. 9
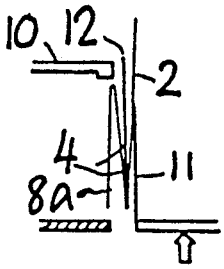
FIG. 10
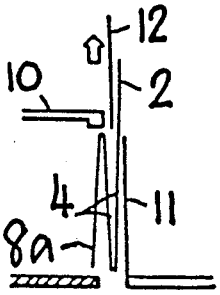
FIG. 11
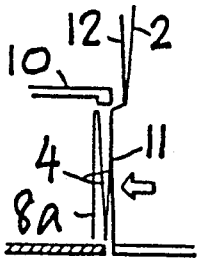
FIG. 12
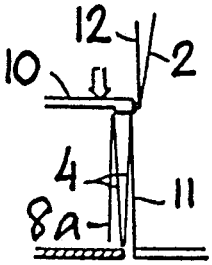
FIG. 13

FIG. 18
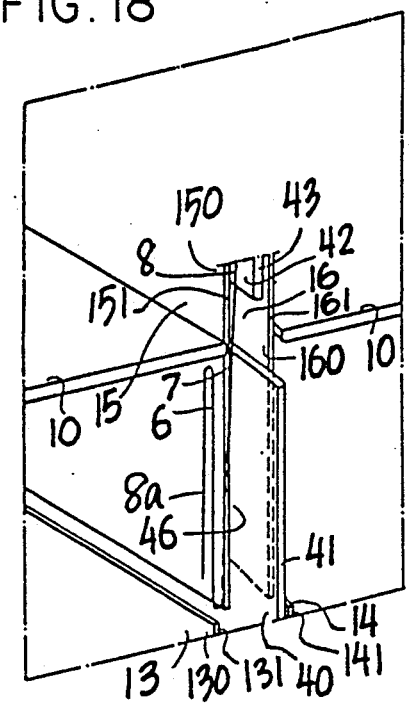
FIG. 19
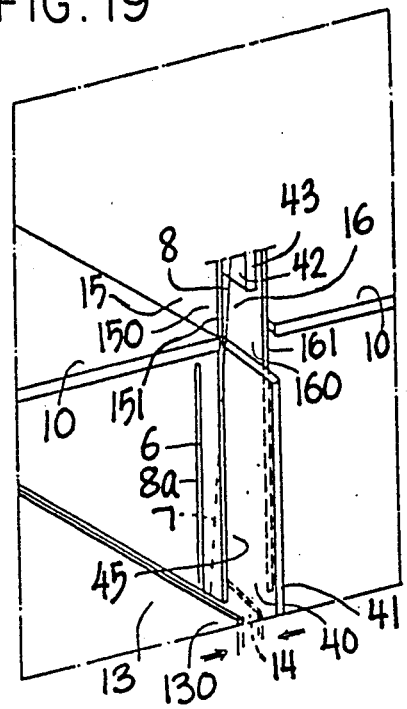
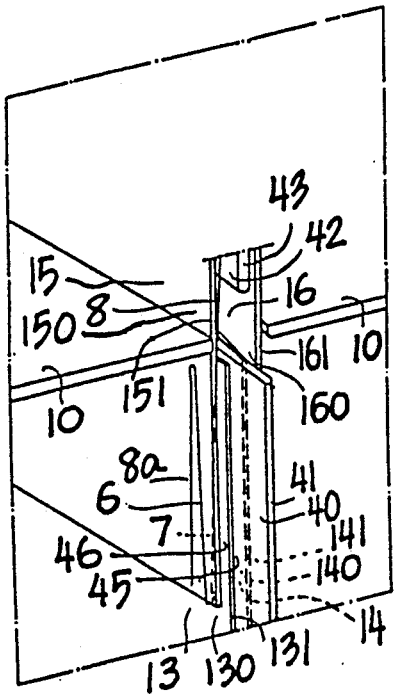
FIG. 20
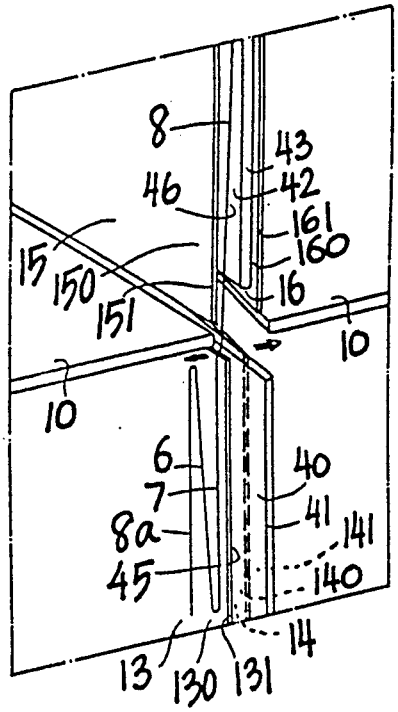
FIG. 21

METHOD FOR FOLDING FILM MATERIAL TO FORM A POLYGON PACKAGE OF SUCCESSIVE FOLDS

This is a divisional of copending application Ser. No. 7/278,828 filed on 12/2/88, now U.S. Pat. No. 4,936,819, issued 6/26/90.

FIELD OF THE INVENTION

The present invention relates to a device and to a method for the manufacture of a hose package from a hose of flexible material, where the hose wall in the package formed by the hose is embedded as folds situated outside one another seen from the center line of the package.

BACKGROUND

From U.S. Pat. No. 4,265,439 a technique for the manufacture of a hose package of the abovementioned type is known which starts out from a hose of flexible material, e.g. plastic film. This U.S. patent specification discloses the provision of lower folding means, upper folding means and fixing means, the fixing means being adapted so as to be moved from an initial position to a fixing position wherein the fixing means in order to form a first wall element of the hose package, fixes a predetermined length of an end portion of the hose against the lower folding means. The upper folding means subsequently is moved from an initial position to a position close to the lower folding means and opposite the side of the lower folding means where the wall element formed first is situated. During this movement the upper folding means pulls with it a portion of the hose and thereby forms two further wall elements of the hose package. The lower folding means thereafter is moved from the position wherein the two wall elements just mentioned were formed, and thereafter to a position on the opposite side of said two wall elements, whereupon the upper folding means returns to its initial position. The lower folding means then is moved back to the position wherein the fixing means fixes the pulled-down hose against the lower folding means. During this movement the lower folding means leads the two wall elements just formed to positions adjoining the wall element(s) formed earlier. The means specified repeat thereafter the movements just described, and in each such cycle of movements form two new wall elements. The process is repeated until a predetermined number of wall elements has been obtained and the desired hose package has been manufactured.

The abovementioned patent specification discloses an apparatus whose folding means form polygons. The design of the upper folding means is not described in detail, but it is evident from the figures that it is constituted of a number of plates which are connected in the outer corner regions of the upper folding means because the plates are bent in those regions. The lower folding means also consists of plates, which each have end regions included in two unequal corner regions of the lower folding means corresponding to two unequal corner regions of the upper folding means. In the corner regions the plates of the lower folding means are terminated by substantially vertical edges. Between the end regions of the lower folding means situated adjoining one another an opening is provided whose size is altered during the folding process. In accordance with said U.S. patent specification, the upper folding means, when pulling down the hose for the formation of new wall elements, passes inside the lower folding means, that is to say closer to the center in relation to wall elements of the hose package already formed. To make this passage possible, the lower folding means, by moving apart the end regions adjoining one another, moves the wall elements of the hose package formed already to such positions that the upper folding means becomes clear of the wall elements, even in the parts of the corner regions formed where the lower folding means is not in contact with the last formed wall element. To ensure a satisfactory function it is necessary, therefore, that the upper folding means in its bent corner region should be at a relatively great distance from a connecting plane between the end edges of the lower folding means in the corresponding corner region. This in turn leads to an undesirably great distance between the newly added folds and the folds completed already, which complicates the folding process in the corner regions of the hose package. Also, the return of the lower folding means to the initial position, and in that case especially its movement inside the wall elements formed already, is critical in accordance with the known technique, since the space inside the wall elements formed already is limited in the corner regions. The wall elements formed already have a tendency, therefore, to accompany the folding means, at least in the upwards directed movement. Such an undesirable pulling along of a wall element as a rule causes damage to the wall element, e.g. the formation of holes in the material.

A further problem which arises in connection with the design of the folding means as described above is that the formation of wrinkles is readily possible, and that undesirable braking of the film may occur in the corner regions when the upper folding means pulls the hose down for the formation of further wall elements. Wrinkle formations and braking effects bring with them only too often damage to the material and, in unfortunate cases, penetration of the material so that holes are formed. Damage to the film of the aforementioned kind are difficult to detect on the finished hose package and are not acceptable.

Corresponding problems arise also in the embodiment where the hose package is formed in that newly added folds are being placed outside the folds formed already.

SUMMARY OF THE INVENTION

The present invention seeks a device where the problems mentioned above are eliminated. This is achieved in that the lower and the upper folding means are formed of a number of plates which are oriented mainly in the axial direction of the hose package to be manufactured, that the plates are placed in pairs adjoining one another, that each pair of plates in one of its end regions forms a corner in the polygon which the respective folding means presents, and that in the respective corner region the plates are arranged at a distance from one another so as to form an opening or a gap respectively between themselves.

The problems mentioned above involving wrinkle formation of the material in the corner regions occur in the apparatus described in U.S. Pat. No. 4,265,439, especially when the hose consists of a thin, flexible material because, among other things, the hose is allowed to hang substantially freely between the means provided for extension of the hose in its circumferential direction in the upper part of the apparatus and the lower edge of the upper folding means. This problem is eliminated in accordance with a preferred embodiment of the present invention, in that guide rules are included in the device in an axial direction thereof, that is to say in the direction of movement of the hose, which on their outer edge form a guide surface for the hose, this guide surface being situated, when the upper folding means is in its upper position, in the area of a connecting surface between the boundary surfaces of the end edges in the corner regions of the plates arranged in pairs next to the respective rule. The guide rules in general are pressed (by some means) against the inner surface of the hose for the purpose of stretching (expanding) the hose in its circumferential direction and at the same time creating friction forces between the guide rules and the hose. Due to the friction forces, a movement of the hose towards the region of fold formation is exposed. As a result, the hose material is always kept stretched in the longitudinal direction of the hose as well as in the circumferential direction.

The stretching of the hose material in the circumferential as well as in the longitudinal direction in certain applications represents a measure which further reduces the risk of wrinkles and damage to the hose material in connection with the formation of the hose package.

The substantially free arrangement of the hose in the region between stretching elements and the contact region in connection with the lower edge of the upper folding device referred to in the foregoing passage with regard to the previously known apparatus, also creates problems in certain applications when a finished hose package is to be severed from the hose not yet folded. The problems arise because one or more of the wall elements formed last can easily be pulled out of the hose package when the hose package is severed from the hose. In order to eliminate these problems mechanical pressing means are provided in a preferred embodiment of the present invention, each of which is adapted so that with a contact edge it extends through a separate gap for each pressing means, formed on the lower folding means between two plates co-operating in pairs in their end regions. The pressing means presses the most recently formed wall elements in the outer corner regions against the wall elements formed earlier. The circumference of the hose and the movement of the pressing means are adapted to each other so that the desired stretching of the wall elements formed last is achieved at the same time as they are fixed against the wall elements formed earlier. A fixing of all the wall elements formed occurs. In this manner, the problems mentioned regarding the pulling out of wall elements from the hose package in connection with its being severed from the hose not yet folded are eliminated.

The mechanical pressing means described in the foregoing paragraph also supplement the means described earlier for the prevention of damage to wall elements formed already through movements of the folding means during the working cycle of the device. This is done in that the shape of the wall elements is improved in the corner regions of the hose package, that the packing density of the wall elements in the corner regions is increased and that the risk of wrinkle formations and damage to the hose material in the regions just mentioned is reduced.

BRIEF DESCRIPTION OF THE FIGURES OF THE DRAWING

The invention will be described in more detail in connection with a number of Figures, wherein

FIGS. 2–13 show stepwise and schematically a principle of the manufacture of the hose package.

FIGS. 14–23 show in perspective details of the corner regions of folding means.

DETAILED DESCRIPTION OF PREFERRED EMBODIMENTS

Figure 1:
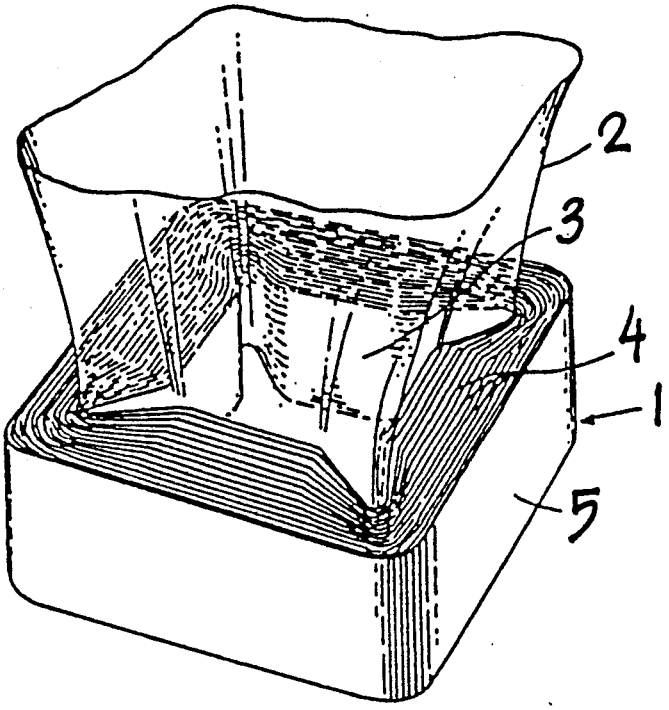
FIG. 1 shows in perspective an embodiment of a hose package produced by the method of the invention.

FIG. 1 shows an embodiment of a hose package 1 with an inner mantle surface 3 and an outer mantle surface 5, where part of a hose 2 is situated outside the hose package. The inner mantle surface 3 has the shape of a four-point star. It is evident from the figure that the hose in the hose package is embedded in a number of wall elements connected with one another and oriented mainly parallel with the mantle surfaces and situated between these. Two wall elements located adjoining one another are connected to one another, as a result of which folds 4 are formed by the pairs of wall elements. Since each wall element is made up of a hose which along its whole length has substantially the same circumference, the folds situated outside the inner mantle surface are successively stretched more and more. By this is meant that the material in each fold is mainly flat, but that larger or smaller inwards directed bends are formed, depending upon where the fold is situated in relation to the mantle surfaces. The result of this is that the extreme fold, which forms the outer mantle surface 5, substantially follows the shape of a polygon which in the embodiment shown in the Figure is a quadrangle.

FIGS. 2–13 show schematically the manufacture of an individual hose package and a device in principle for this purpose. A fixing means 10, a lower folding means 11 and an upper folding means 12 co-operate to make a portion of a hose 2 into the hose package 1. This is formed either by folding from the inside and outwards, when the shape of the lower folding means 11 mainly follows the shape of the inner mantle surface 3 of the hose package, or by folding from the outside and inwards, when the shape of the lower folding means mainly follows the shape of the outer mantle surface 5.

FIG. 2 shows how the manufacture of a hose package is started with the lower and the upper folding means 11 and 12, respectively in their initial positions. The free end of the hose is pulled down over the lower folding means 11 so as to form a first wall element **8*a* of the hose package, whereupon the lower folding means is moved one step transversely to the longitudinal direction of the hose to a position (see also FIG. 3) where the hose, as a result of a subsequent movement of the fixing means, is clamped between this and the lower folding means. This clamping is achieved in that the fixing means 10 is moved from the initial position shown in FIG. 2 to working position shown in FIG. 4**.

The upper folding means 12 with its lower boundary surface 120 thereafter pulls down a predetermined length of hose (see also FIG. 5 and 6) which during the pulling down slides over the lower boundary surface of the folding means to form two wall elements 6, 7 situated substantially next to one another, which are placed next to the lower folding means 11 and together form a first fold 4 of the folds which jointly will form the hose package.

FIGS. 7–10 illustrate how the fixing means 10 returns to its initial position and the lower folding means 11 is moved from the position wherein the wall element 6, 7 just mentioned was formed and thereafter to a position on the opposite side of said wall element. The position now assumed by the lower folding means 11 corresponds to its initial position, that is to say the position the lower folding means occupies in FIG. 2. The upper folding means too returns to its initial position (see FIG. 11), whereafter the lower folding means is moved one step outwards from the center of the future hose package, that is to say one step to the left (see FIG. 12), and assumes the position which corresponds to the position in FIGS. 3 and 4. The fixing means 10 thereafter is moved to its working position (see FIG. 13) and once again locks the hose material against the lower folding means. The operations described are repeated until a predetermined number of folds has been obtained, whereupon the hose package so formed is severed from the remaining part of the hose.

Figure 24:
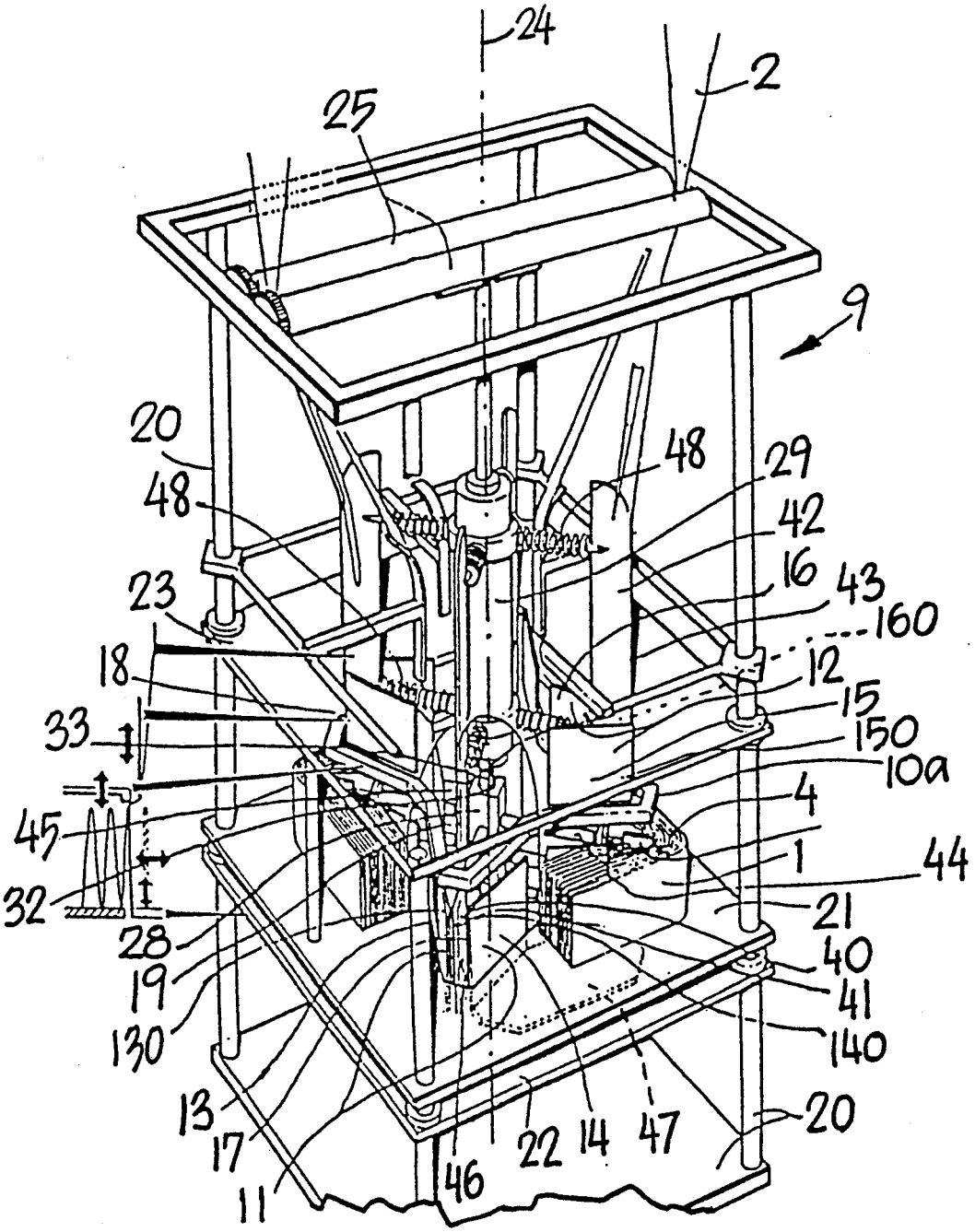
FIG. 24 is a perspective view of a device for carrying out the method in accordance with the invention.

FIGS. 14–23 show in perspective details of the fixing means 10 together with the lower and upper folding means 11 and 12 respectively in the corner regions thereof (see also FIG. 24). The figures show an embodiment of the invention which in addition to guide rules 42 with an outer edge 43 also comprises mechanical pressing means 40 with a contact edge 41. It is evident from the figures that the lower folding means 11, as well as the upper folding means 12, in their corner regions include substantially vertically oriented plate like means 13, 14 and 15, 16, respectively which are situated at a distance from one another. The folding stages described in FIGS. 2–13 correspond to the stages shown in FIGS. 14–23 where FIG. 4 and FIG. 14, FIG. 5 and FIG. 15, etc. are related and illustrate corresponding operating sequences. FIGS. 14–23 thus show in detail the positions of the elements of the apparatus in a corner region of an embodiment in accordance with the invention. The movements and the function of the means will be explained in more detail below after the device illustrated in FIG. 24 has been described in FIGS. 14–23, moreover, a line 8 has been inserted corresponding to a section through the hose from which the hose package is formed.

In FIG. 24 there is shown, a device 9 for the manufacture of the hose package 1. The device comprises a frame 20, a machine table 21, a forming table 22 and a pulling table 23. In the embodiment of the device shown the machine table 21 is firmly mounted on the frame 20, whereas the pulling table 23 and the forming table 22 are movable by driving means (not shown in the figures) in the direction towards, and away from, the machine table 21.

The forming table 22 is provided with plates 13, 14 (see also FIGS. 14–23) which accompany it in its movement and which are oriented mainly in the axial direction 24 of the device, that is to say in the axial direction of the hose package which is to be manufactured. The plates are placed in pairs adjoining one another and form end regions 130, 140 which have end edges 131, 141 pointing away from the center region of the device, and constituting corner regions 17 of a polygon. In the figures, the plates are shown in an embodiment where they are arranged so as to form an acute angle with each other and where they are nearest to one another in the end regions 130, 140 just mentioned. The plates are movable towards, and away from, one another by means of driving elements (not shown in the figures). In a preferred embodiment the plates are fixed in pairs to a common carrier means 47, each corner in the polygon formed by the lower folding means being constituted of plates 13, 14 which are each supported by its carrier means.

The carrier means 47 is movable by driving elements (not shown in the figures) between two end positions, the movements of the carrier means taking place mainly in the direction towards, or away from the center axis 24 of the device. Said movements are co-ordinated so that the carrier means for all plates are moved substantially at the same time in the direction towards the center axis to the position which corresponds to the position of the lower folding means in FIGS. 2, 11 and 21 and in the direction away from it to the position which corresponds to the position of the lower folding means in FIGS. 3, 12 and 22. In the end position of the movement towards the center axis the plates as a rule are situated, at least in the end regions 130, 140, at a certain, generally small, distance from each other and form an opening 45 into which the mechanical pressing means 40 can fit. The pairs of plates jointly form the lower folding means 11. The mechanical pressure means 40 are arranged between each pair of end regions 130, 140 and are movable by driving means 44 in the direction towards, or away from, the center axis 24 of the device. The driving means 44 as a rule are connected to a lower (first) central body 29 which is located in the region of the machine table 21, and as a rule is connected to the machine table 21 and/or the frame 20 of the device. At the least, when the mechanical pressing means is in its position farthest from the center axis 24 of the device, the outer contact edge 41 of the means is situated outside a boundary surface connecting the end edges 131, 132 of the plates 13, 14 of the lower folding means 11 in their end regions 130, 140. As a result the mechanical pressing means press the folds formed outwards in the corner regions, so that the hose material is stretched, possible wrinkle formations are smoothed out and folds (wall elements) formed already are fixed, in addition to which space is provided for movements of the folding means 11, 12.

The upper folding means 12 is constructed in a similar manner comprising a number of plates 15, 16 (see also FIGS. 14–23) placed in pairs close to one another and forming end regions 150, 160 within each pair which have end edges 151, 161 pointing away from the center region of the device and constituting corner regions 18 in a polygon. The plates 15, 16 are fixed to the pulling table 23 and accompany the pulling table in its movement in the direction towards, or away from, the machine table 21. Centrally in the device, and above the lower central body, an upper (second) central body 29 (see FIG. 24) is provided to which guide rules 42 are connected via mechanical driving elements 48, which in the figures are in the form of springs. The outer edge 43 of the guide rules faces away from the center axis of the device, this edge forming a guide surface for the hose. This guide surface is located in the region of a connecting surface between the boundary surfaces of the end edges 151, 161 of the plates of the upper folding means in the end regions 150, 160. At the least in said end regions, the plates arranged in pairs are situated at such a great distance from one another that between the plates a gap 46 is formed which is sufficiently large to allow the respective rule to pass through the gap. The guide rules stretch the hose in its circumferential direction and ensure through this that the hose material (the film) is even when the hose is pulled down by the upper folding means 12 so as to pass into the region of the device where the wall elements of the hose package are formed. Between the hose material and the guide rules, friction forces are generated which, in accordance with the invention, are adapted so that they stop almost immediately any movement of the hose material in the direction towards the folding means when no pulling forces are exerted on it. It also should be pointed out that the design of the driving element 48 is such that the positions of the guide rules are adapted to the dimensions of the hose and allow its circumference to vary while retaining the function of the guide rules and maintaining the operational reliability of the device.

Figure 14:
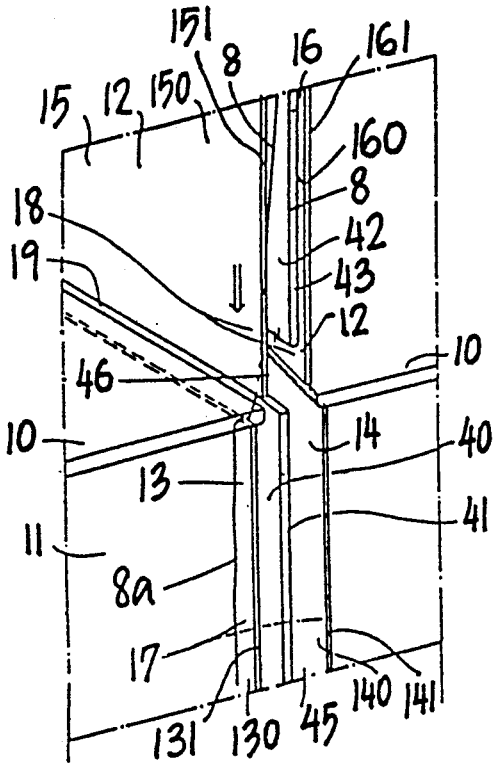
Figure 15:
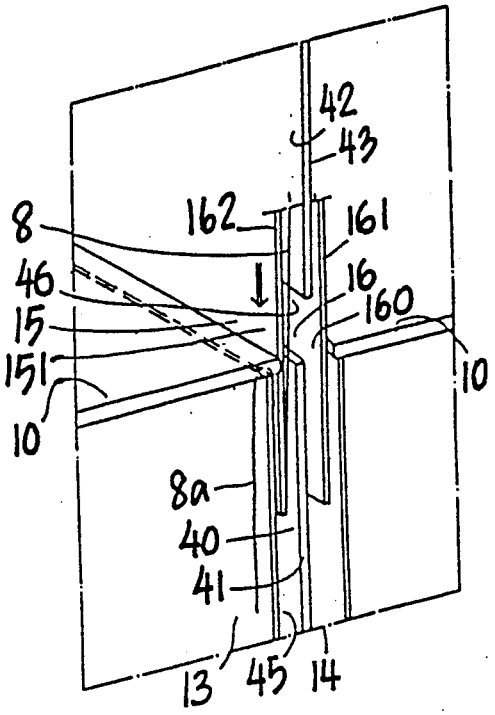

FIG. 14 shows in detail the hose material 8 pulled down so that a first wall element 8*a* has been formed at the same time as the hose material is fixed between the fixing means 10 and the plate 13 of the lower folding means 11. The plates 15, 16 of the upper folding means 12 in FIG. 15 are moved downwards in the figure pulling down the film material. The mechanical pressing means 40 continues to be in an initial position next to the center of the device.

Figure 16:
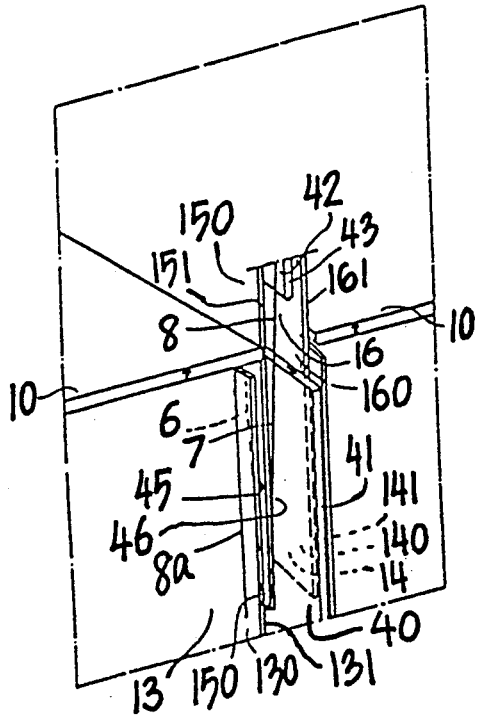
Figure 17:
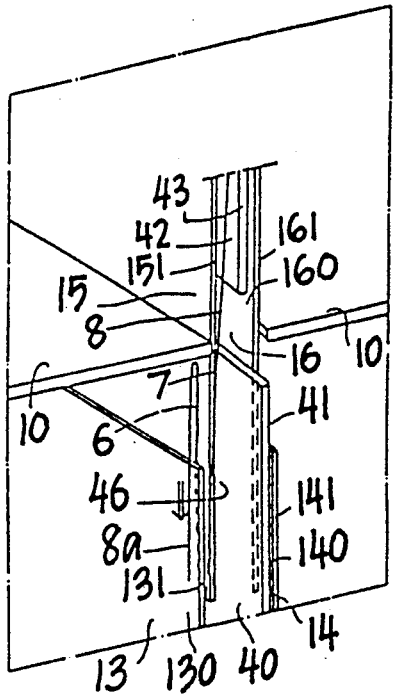
Figure 23:
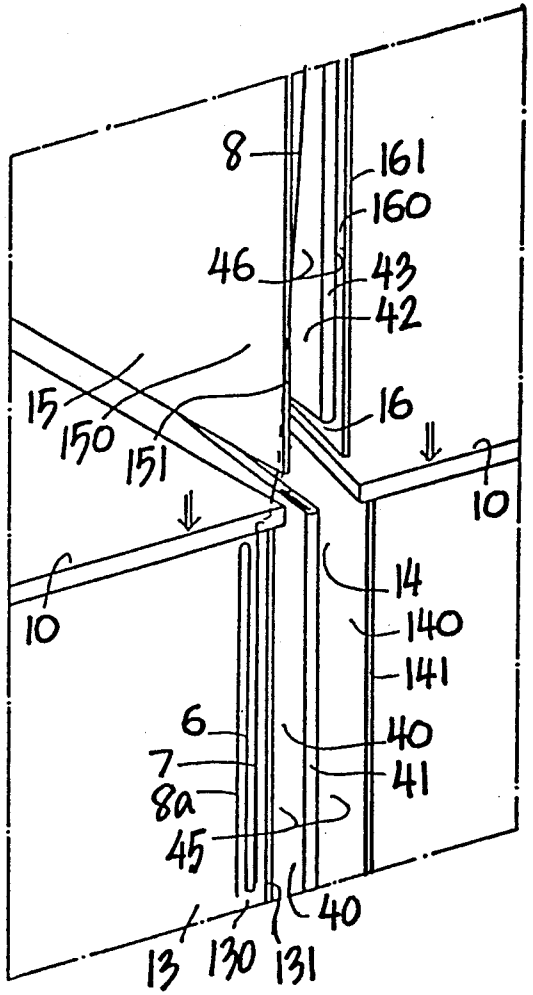
Figure 22:
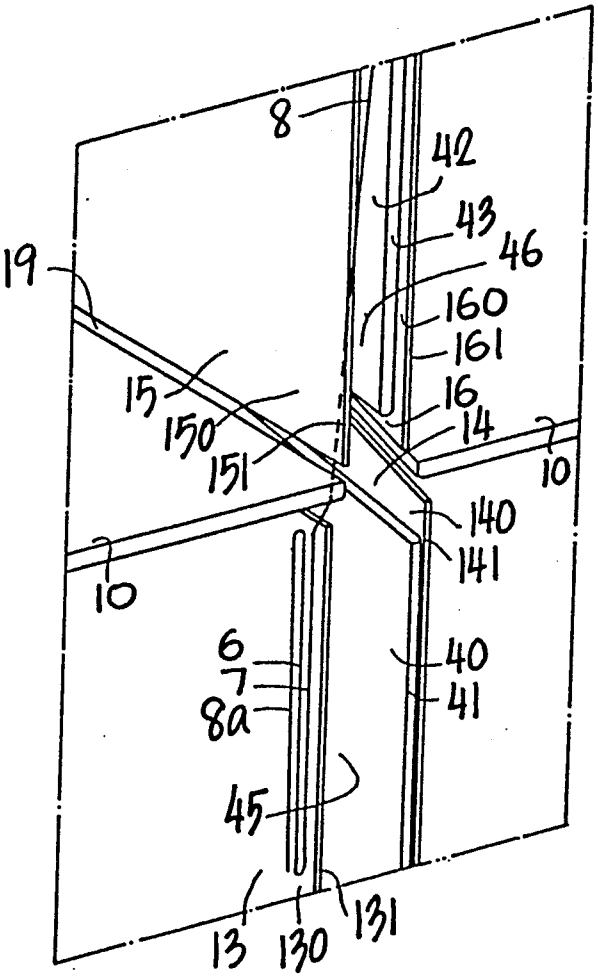

In FIG. 16 the pulling down of hose material is completed and the first fold consisting of wall elements 6, 7 has been formed. The pressing means 40 has been moved with its pressing edge 41 to the position farthest from the center of the device. As a result the material in the corner region of the newly formed wall elements 6, 7 is pushed out from the center of the device with simultaneous smoothing out of any wrinkles and overlaps on the hose material. At the same time, the fold formed is locked in the corner region because the contact edge 41 is stretching the material in circumferential direction and thereby fixing the wall elements formed. Thereafter the plates 13, 14 of the lower folding means are moved downwards in the figure (see FIG. 17) to the position which is shown in FIG. 1, whereafter the plates 13, 14 are moved towards one another in the end regions 130, 140 to the position which is shown in FIG. 19.

The plates 13, 14 thereafter are moved upwards on each side of the mechanical pressing means 40 and inside the newly formed wall element 7 (see FIG. 20). Thereafter the plates 15, 16 of the folding means 12 are moved to their initial position (see FIG. 21) at the same time as the wall elements 6, 7 formed continue to be held in fixed position by the mechanical pressing means 40. When the upper folding means has reached its initial position, the movement of the end regions 130, 140 of the plates 13, 14 of the lower folding means away from one another commences (see FIG. 21), so that the end regions occupy the positions shown in FIG. 22. When this movement occurs, the wall elements formed are guided towards one another at the same time as the hose material in the corner regions is stretched over the contact edge 41 of the pressing means 40 and the end edges 131, 141 of the end regions 130, 140 of the lower folding means. When this stretching and displacement movement of the material in the wall elements is completed, the fixing means 10 is moved to its fixing position whilst the mechanical pressing means 40 returns to its initial position (see FIG. 23). Thereafter the procedure just described is repeated to allow the formation of a further fold composed of two new wall elements corresponding to the pair of wall elements 6, 7 formed earlier.

A lower guide element 32 (see FIG. 24) is provided on the lower central body 28 to co-operate with an upper guide element 33 on the upper central body 29. The lower central body 28 is movable to a position wherein the lower guide element 32 is situated close to, or under, the upper surface of the machine table 21 so as to make possible the withdrawal of a completed hose package 1.

The lower (first) and upper (second) guide elements 32, 33 center the mutual positions of the central bodies 28, 29 when the lower central body, and with it the lower folding means 11, is returned to its initial position for the commencement of the manufacture of a hose package. During the folding of the hose package the two guide elements co-operate with one another so as to center the positions of the guide rules, thus ensuring that the hose obtains a correct position in relation to the folding means 11, 12 at the passage over the guide rules 42. Feed rollers 25 are provided for the leading in of the hose 2 into the device.

The machine table 21 is provided with one or more recesses which are dimensioned so as to allow the lower folding means 11 to pass when it is moved in the axial direction of the device (axial direction of the hose package) and also to allow its plates 13, 14 to describe the paths of movements transversely thereto specified earlier.

The fixing means 10 is shown in FIGS. 14–23 as being composed of a number of disks whereas in the embodiment shown in FIG. 24 it is designed as a barlike means 10*a* whose shape is adapted to the polygon formed by the lower folding means 11 and the upper folding means 12 respectively. It will be obvious to those skilled in the art that the design of the fixing means can vary from case to case. This applies correspondingly to its mounting in the device. Thus, the fixing means may be attached e.g. to the pulling table 23, the machine table 21 or it may be connected to the frame of the device and be adapted so as to be moved by driving elements, not shown in the figures, mainly in the axial direction of the device between an initial position and a working position wherein, as described previously, the fixing means locks the material of the hose against the upper edge surface of the lower folding means 11. The fixing means 10*a*, just as the fixing means 10 composed of disks described earlier, has a central space through which passes the upper folding means 12 upon pulling down the hose material for the formation of wall elements 6, 7 of the hose package 1 and on returning to its initial position.

In the above description the expressions upper folding means and lower folding means were used and likewise movements upwards and downwards were specified. These indications of direction are intended only to relate to the orientation of the folding means or the devices in the Figures. It will be obvious to those skilled in the art that said means or arrangements may have an arbitrary orientation in space.

The foregoing detailed description referred only to a limited number of embodiments of the invention, but it will be clear to those skilled in the art that the invention embraces a large number of embodiments within the scope of the subsequent claims.

What is claimed is:

1. A method for the manufacture of a hose package comprising pulling a tubular hose axially by spaced upper folding plates disposed around the hose and successively forming folds in the axially pulled hose on spaced lower folding plates to form overlapping wall elements defining a package of polygonal shape with a central axis, straight sides and corner regions, guiding the hose in said corner regions as the hose is axially pulled and folded, and radially displacing pressing plates within the overlapped wall elements of the package, relative to said upper folding plates, for applying pressure to the folds of the overlapping wall elements in said corner regions in a radially outwards direction to press the folds outwards in said corner regions to circumferentially stretch the hose and prevent formation of wrinkles therein.

2. A method as claimed in claim 1 wherein the pressure is applied to the overlapping wall elements in said corner regions by said pressing plates from a central body within the package.

3. A method as claimed in claim 1 comprising opposing pulling of the hose by said upper folding plates to effect stretching of the hose in an axial direction during axial pulling of the hose by said folding plates prior to the forming of the overlapping wall elements of the package.

4. A method as claimed in claim 3 wherein the stretching of the hose in the axial direction is effected by frictionally engaging the axially pulled hose in portions of the hose which are to form said corner regions.

5. A method as claimed in claim 4 wherein said hose is frictionally engaged by guide rules before the hose is folded by said folding plates.

6. A method as claimed in claim 5, said guide rules applying radial forces to said hose to stretch the hose circumferentially while the hose is being stretched axially.

7. A method as claimed in claim 6 comprising positioning the guide rules to extend between the spaced upper folding plates such that as said upper folding plates are displaced to form the overlapping wall elements of the hose, the guide rules remain in place at the initial position of the upper folding plates to continue to apply radial and frictional forces to the hose.

8. A method as claimed in claim 1 comprising radially displacing said pressing plates between the upper folding plates to stretch the hose circumferentially in said corner regions.

9. A method as claimed in claim 1, said spaced upper folding plates moving from an upper position to a lower position when pulling the tubular hose axially, said spaced lower folding plates moving radially between inwards and outwards positions and between raised and lowered positions, said spaced upper folding plates being fitted within the spaced lower folding plates when the upper folding plates are in said lower position and the lower folding plates are in said raised position, said hose undergoing folding on said lower folding plates as said upper folding plates travel to said lower position and pull the hose therewith, said pressing plates being radially displaced relative to said upper folding plates when the latter are in said lower position by displacing said pressing plates between the spaced upper folding plates to a position outwardly thereof.

10. A method as claimed in claim 9 comprising positioning guide rules to project between the spaced upper folding plates at the level of said upper position of said upper folding plates such that as the upper folding plates pull the hose axially, the hose travels on said guide rules and undergoes frictional engagement and circumferential stretching.

* * * * *